US005092486A

United States Patent [19]

vom Hofe et al.

[11] Patent Number: 5,092,486

[45] Date of Patent: Mar. 3, 1992

[54] APPARATUS AND METHOD FOR PACKAGING CONTAINER

[75] Inventors: Dieter vom Hofe, Juelich; Siegfried Konkel, Duesseldorf, both of Fed. Rep. of Germany

[73] Assignee: Henkel Kommanditgesellschaft auf Aktien, Duesseldorf-Holthausen, Fed. Rep. of Germany

[21] Appl. No.: 613,526

[22] PCT Filed: May 2, 1989

[86] PCT No.: PCT/EP89/00482

§ 371 Date: Nov. 8, 1990

§ 102(e) Date: Nov. 8, 1990

[87] PCT Pub. No.: WO89/10878

PCT Pub. Date: Nov. 16, 1989

[30] Foreign Application Priority Data

May 9, 1988 [DE] Fed. Rep. of Germany ..... 3815747
Apr. 3, 1989 [DE] Fed. Rep. of Germany ..... 3810680

[51] Int. Cl.[5] ..... B65D 5/44; B65D 5/60

[52] U.S. Cl. ..... 220/465; 229/121

[58] Field of Search ..... 229/121; 206/621.3, 206/621.6; 220/403, 410, 462, 465; 222/541, 547, 564

[56] References Cited

U.S. PATENT DOCUMENTS

| | | | |
|---|---|---|---|
| 2,593,019 | 4/1952 | Glaser | 229/121 |
| 2,926,832 | 3/1960 | Negoro | 229/121 |
| 3,172,570 | 3/1965 | Lipschutz | 220/465 |
| 3,227,322 | 1/1966 | Crain | 220/462 |
| 3,756,471 | 9/1973 | Wissman | 220/465 |
| 4,516,692 | 5/1985 | Croley | 222/541 |
| 4,623,075 | 11/1986 | Riley | 220/462 |

FOREIGN PATENT DOCUMENTS

| | | | |
|---|---|---|---|
| 456106 | 11/1936 | United Kingdom | 206/621.3 |
| 632222 | 11/1949 | United Kingdom | 206/621.3 |
| 1353079 | 5/1974 | United Kingdom | 206/621.3 |

*Primary Examiner*—Gary E. Elkins
*Attorney, Agent, or Firm*—Ernest G. Szoke; Wayne C. Jaeschke; Kenneth Watov

[57] ABSTRACT

In a packaging container of the bag-in-box type for accommodating a liquid product, an article to be added for measuring the liquid product can be included if the volume enclosed by the rigid envelope of the container is made larger than the volume of the flexible sack containing the product by the volume of the article and if the envelope has a reclosable window flap for introducing and removing the article.

22 Claims, 10 Drawing Sheets

APPARATUS AND METHOD FOR PACKAGING CONTAINER

BACKGROUND

1. Field of the Invention

This invention relates to generally and more particularly to packaging containers to containers for accommodating a liquid product, including a rigid envelope containing, a flexible sack with a closable outlet bung and, associated therewith, a passage or bunghole in the envelope. The invention also relates to processes for filling such packaging containers and dispensing liquid products therefrom.

2. Discussion of Related Art

A key feature of packs of this type, as described in DE-OS 34 10 717, is the sack or bag for accommodating liquid which is arranged in a stable packaging container, for example of corrugated cardboard, a carton or the like and includes an outlet bung. The outlet bung is generally welded into the preferably plastic sack. Bag-in-box containers such as these are used as an alternative to bottles or canisters particularly as a supply pack for liquid chemicals for institutional use, but also for beverages, such as wine, for domestic use. In practice, the quantities of liquid involved are relatively large, for example up to 30 liters.

To remove the liquid contents, the flexible sack integrated in the packaging container has a closable outlet bung. When the container is used for the first time, the outlet bung is pulled outwards through an opening, for example a prepunched opening, in a surface, preferably the top of the container. In the pouring position, the outlet bung can be held fast or locked in the bunghole associated with it in the top of the pack. This withdrawal and fixing of the outlet bung involves considerable effort where the bunghole just fits for fixing, i.e. is small. If, by contrast, the bunghole is made larger to make the outlet bung easier to remove from the pack, pouring out becomes more difficult because the outlet bung has to be separately fixed during pouring.

Another problem arises when, for reasons of pollution control, separate disposal is required for the folding box and the empty plastic bag. This problem occurs whenever the outlet bung is carefully fixed in the wall of the packaging container for convenient handling during pouring, creating difficulty in separating the plastic parts of the pack from the cardboard parts.

To enable a user to easily dispense the liquid product, as in cases where bottles or canisters are used for packing, it is standard practice to supply with the pack measuring cups or small in-use containers for daily use. Where the liquid is supplied in bottles or canisters, the articles to be added are pushed, for example, onto the outlet spout of the bottle or canister, or are suspended from the container. Fixed in this way, the added article can be lost pending sale. In addition, externally arranged articles make the packs difficult to stack. This applies to a greater extent in the case of bag-in-box containers because, typically packs of this type can be given a square form for facilitating stacking.

The problem which the invention seeks to solve is removably to integrate the article to be added to the packaging container for dispensing or using the liquid product in a reclosable bag-in-box container in such a way that there is no need for special fixing elements on the outer surface of the pack. The article to be added cannot be accidentally lost pending sale. Automated addition of the article must be provided. Articles of different shape must be accommodated without impairing the stackability of the pack when adding such articles while providing for removal of the articles without impairing the serviceability of the container.

SUMMARY OF THE INVENTION

For a packaging container comprising a stiff envelope and a flexible sack mounted therein, one embodiment of the invention provides for an article to be added for handling the product to have a design permitting the article to be introduced at a predetermined position into the space between the envelope and the sack, and further includes an embodiment whereby the wall of the envelope has a reclosable window flap for removing and replacing the article to be added.

By virtue of the invention, the article to be added can be stored inside the rigid envelope or outer enclosure or housing. In this way, the article to be added cannot be lost pending sale. In addition, it does not affect the outer shape of the envelope in any, thereby preserving the stackability of the envelope. For use, the article to be released, for example a measuring cup, can be removed by opening the window flap. Because the window flap is reclosable, this can be done with no adverse effect on the serviceability of the container. No troublesome fixing elements are provided on the outer surface of the container for fixing the article to be added. Overall, the invention provides an environment-friendly alternative to the plastic bottles or canisters hitherto used in the home where dishwashing detergents, laundry detergents, cleaning liquids or conditioners are packed in containers of the field of the invention.

To facilitate automated addition of the article to the container, another embodiment of the invention provides a method for filling the packaging container whereby, after the sack has been filled and introduced into the rigid envelope, but before closing the rigid envelope, the article is pressed into the outer surface of the sack, whereafter the envelope is closed. In this way, automated addition of the article in the form of a measuring cup, in-use container or the like is readily accommodated.

In another embodiment of the invention, the window flap, more especially in the form of a reclosable originality closure, adjoins the intended position of the article to be added. By opening the window flap, the article can be removed without difficulty or, particularly where the window flap is reclosable, can be replaced in the envelope. In another embodiment of the invention, a favorable mutual association is obtained, particularly in the case of carry packs, if the window flap is arranged in the upper end face and, more preferably, in the same surface as the bunghole. This simplifies handling and, where the window flap is arranged in the top of the container, enables the article to be pressed in without the pack overturning or having to be held.

In another embodiment of the invention, the volume enclosed by the rigid envelope is only larger than the volume of the filled sack, including the outlet bung, by the volume of the article to be added. In practice, this means that the dimensions of the envelope only have to be minimally changed in relation to the case or envelop of a similar pack with no integrated measuring or handling article. This is because, regardless of the shape of the article, the volume of the envelope is merely increased by the displacement volume of the added article irrespective of its length, width or height.

If the weight of the volume of liquid displaced by the article to be added is greater than the weight of the article, as is generally the case, the article is automatically forced out the filled pack to a certain extent after opening of the window flap so that it is easy to remove. This easier handling will exist at least for as long as the interior of the container is filled substantially completely with liquid.

In another embodiment of the invention, the packaging container comprises two fully congruent outer head laps lying one above the other, the lower outer head lap comprising a removal opening in the form of a hole for the article to be added and the other, upper outer head lap comprising the preferably reclosable window flap corresponding to the removal opening, and two inner head laps with die cuts or cutouts adapted to the contours of the window flap and the removal opening. The use of fully congruent head laps on that surface of the pack which contains the window flap and, optionally, the outlet bung provides for adequate stability of the pack during storage, transport, stacking etc., even in cases where the window flap defined by an originality closure is oversized to enable the article to be conveniently removed. If other closure flaps are to be provided on the end face of the envelope, these flaps must also have an opening if they coincide with the hole, the window flap or the originality closure.

In one preferred embodiment of the invention, the packaging container in the region of the opening for removal of the article to be added, is designed in such a way that the window flap is connected to the adjoining surface of the head lap via a hinge groove optionally cut into a central region and, at its edge opposite the hinge groove, comprises an insertion lap integrally formed via a folding crease. This facilitates both reclosing and reopening. The insertion position of the insertion lap can be largely safeguarded against accidental opening if the insertion lap formed from an outer head lap is tucked in from both sides level with its folding crease and if an insertion slot holding the insertion lap bent inwards through about 90° is associated with the insertion lap in the inner head lap beneath the window flap. If the insertion lap is tucked in from both sides level with its folding groove, i.e. has a kind of waist, corresponding projections remain in the head lap, below which the projections of the insertion lap laterally adjoining the waist engage on insertion.

In another embodiment of the invention, the opening of an insertion lap designed as indicated above is also facilitated by providing a gripping recess, at its free end opposite the folding crease, preferably in the form of a semicircular griphole, which is cut out by punching for example, during or before production.

In another embodiment of the invention, withdrawal of the inserted insertion lap is facilitated by providing, in its folding crease a convex cutout extending towards the free end of the lap. On bending through 90° and insertion, a projection is formed at the window flap at the gripping recess optionally provided, and can readily be gripped by the finger tips for lifting and tearing out the flap.

In another embodiment of the invention, which is designed to stabilize the closed window flap, the window flap preferably has a larger area than the corresponding removal opening of the underlying head lap and, in the closed position, lies locally on the remaining parts of the lower head lap.

Another embodiment of the invention provides, between the pouring opening and the adjoining sack, an outlet bung including a neck with two integrally formed, radially projecting flanges, with the distance between the flanges being substantially equal to the wall thickness of the envelope in the region of the bunghole, with the outer periphery of the neck being adapted to the passage defined by the bunghole, and wherein, around approximately one quarter of its circumference, the bunghole adjoins a window in the envelope large enough to grip through.

As a result of the window adjoining the bunghole and the adapted configuration of the outlet bung and the bunghole, the outlet bung arranged in the originality pack inside the envelope can be pulled outwards from inside the pack via a user's fingers, after the bunghole has been broken open and the window opened, and can be pushed laterally into the bunghole opened to the window in such a way that the flanges provided on the neck of the outlet bung adjoin the envelope surface above and below the edge of the bunghole. In this way, the pack is easier to use. At the same time, the solution according to the invention also provides for easier separation of the folding box and the sack after emptying via laterally pushing the outlet bung out of the bunghole, and withdrawing it together with the attached (preferably by welding) sack from the envelope. The envelope is typically made of corrugated cardboard.

In another embodiment of the invention, the window has a reclosable window flap with a hinge in the form of a crease line provided on the side remote from the bunghole. Such a window flap provides access to the envelope, optionally after an originality closure has been broken open, permitting the outlet bung to be withdrawn and inserted into the opened bunghole, after which the window may be reclosed in such a way that the outlet bung is simultaneously fixed in position in the bunghole.

In another embodiment of the invention, the outlet bung is secured particularly firmly in position in the bunghole if, at its outer edge adjoining the bunghole, the window flap is adapted to the circumference of the side of the outlet bung to be inserted which faces the window, and is secured between the two flanges.

In another embodiment of the invention, the outlet bung is further secured in position, particularly against rotation in the bunghole, if the neck of the outlet bung, in the region between the two flanges, is in the form of a flattened tube section to prevent rotation. The flat sides of the tube section are preferably adapted as guide surfaces between two correspondingly flat sides of the bunghole leading to the window. The outlet bung is thus unable to rotate about its axis, so that a pouring opening provided in the outlet bung always retains a certain predetermined position relative to the pack.

In addition, for the guided and positioned insertion of the outlet bung, it is preferred that a flange of the outlet bung lying on the outside of the envelope is adapted to be distinctly visibly, in the form of a rosette, to an orientation plan provided on the envelope. The user is thus able when using the packaging container for the first time to see how the outlet bung should be correctly oriented.

If the opening of the envelope according to the invention consist of the bunghole and the window formed in a head face of the pack at which several head flaps lie one on top of the other, the edges of the bunghole and the window, in another embodiment of the invention, are congruently formed throughout by all the head laps—lying one above the other—of an envelope wall. This provides not only for satisfactory operation of the elements essential to the invention, but also for the stability, favorable to operation of the envelope wall and the window flap.

For both transport and storage pending sale, it is preferred for the packaging container according to the invention to have a square shape advantageous for stacking, to be sealed. To this end, it is sufficient for the surfaces of the envelope defined by the window and the bunghole to be defined by cut or punched lines interrupted by originality bridges. Accordingly, the originality closure consists of the punched originality bridges which are easy to break during opening of the bunghole and the window. Initial use or breaking open of the envelope for the first time is made even easier if, as in another embodiment of the invention, that section of the cut or punched line provided at the boundary between the window flap and the bunghole is continuous, i.e. has no punched bridges. Such a continuous cut makes the envelope surface originally occupying the bunghole easier to press in. In addition, a continuous cut at the edge of the window flap eliminates possibly troublesome remains of punched bridges during the subsequent fixing or release of the window flap between the flanges of the bung neck.

According to the invention, the window adjoining the bunghole provides a dual-purpose basis for incorporating a user aid, for example a measuring cup, in the pack. In this way, it is possible to integrate an article to be added to the packaging container for measuring or using the liquid product or the like in the bag-in-box container in such a way that there is no need for special fixing elements on the outer surface of the pack, the article to be added cannot be accidentally lost pending sale, automated addition of the article is possible and articles of different shape can be provided for use without affecting the stackability of the pack, as mentioned earlier on.

During the original filling of the packaging container, the user aid is pressed into the outer surface of the filled sack, preferably after filling of the sack, but before closure of the rigid envelope, and is secured in that position by closing the envelope. It is important in this regard to ensure that the user aid lies within the container adjoining the window, so that it can be immediately gripped after opening of the pack originality-sealed pending its use. After the user aid has been removed, the outlet bung can be withdrawn from the window and fixed in the bunghole. In the packaging container according to the invention, the volume enclosed by the rigid envelope is only greater than the volume of the filled sack including the outlet bung by the volume of the article to be added. In practice, this means only a minimal change in the dimensions of the envelope compared with the case of a similar pack without the added user aid. This is because, irrespective of the shape of the user aid, the volume of the envelope is increased solely by the displacement volume of the added article irrespective of its length, width or height.

In tests, it was found that, where the window flap of the packaging container is arranged in the upper outer lap, it is frequently pressed in. This can happen under the effect of loads applied during transport or even during repacking of the packaging container onto shelves pending sale. This is presumably attributable to the fact that the perforation line or die cut defining the window flap and the bunghole have to be weak enough for the user to be readily able to tear open the flap. During transport, however, the measuring aid optionally incorporated in the pack and the outlet bung can press against the window flap from inside and can cause it to open. In order to remedy this situation, another embodiment of the packaging container according to the invention is characterized in that it comprises a fully congruent, lower outer head lap with a window flap and bunghole defined therein by perforation lines or die cuts, in that it comprises two short inner head laps with die cuts or cutouts congruently adapted to the contours of the window flap and the bunghole and in that it comprises a fully congruent, upper outer head lap which completely covers the contours of the window flap and the bunghole.

In order to be able to free the window flap for use in this embodiment of the packaging container, the upper outer head lap in another embodiment of the invention comprises two perforation lines which extend parallel to its longitudinal edge and its pivotal edge and which are arranged outside the contours of the window flap and the bunghole.

In another embodiment of the invention, the outer regions remaining between the perforation lines and the longitudinal edge or pivotal edge are in the form of an glueing surface for joining the two outer head laps.

Finally, in another embodiment of the invention, the upper outer head lap is made easier to tear open if, on one narrow side edge of the middle part defined by the perforation lines, a crease line extending parallel to the narrow side edge is formed to define a gripping strip.

To use the packaging container, the invention provides a process which is characterized in that the press-in surface occupying the bunghole is pressed in to break the originality bridge and the window flap occupying the window is opened outwards. The outlet bung is removed from the interior of the pack and, using the flange provided on its neck, is inserted into the bunghole and fixed in position by closing the window flap.

BRIEF DESCRIPTION OF THE DRAWINGS

Examples of embodiments of the invention are described in detail below with reference to the accompanying diagrammatic drawings, in which like items are identified by the same reference designation, wherein.

DETAILED DESCRIPTION OF THE INVENTION

Figure 1:
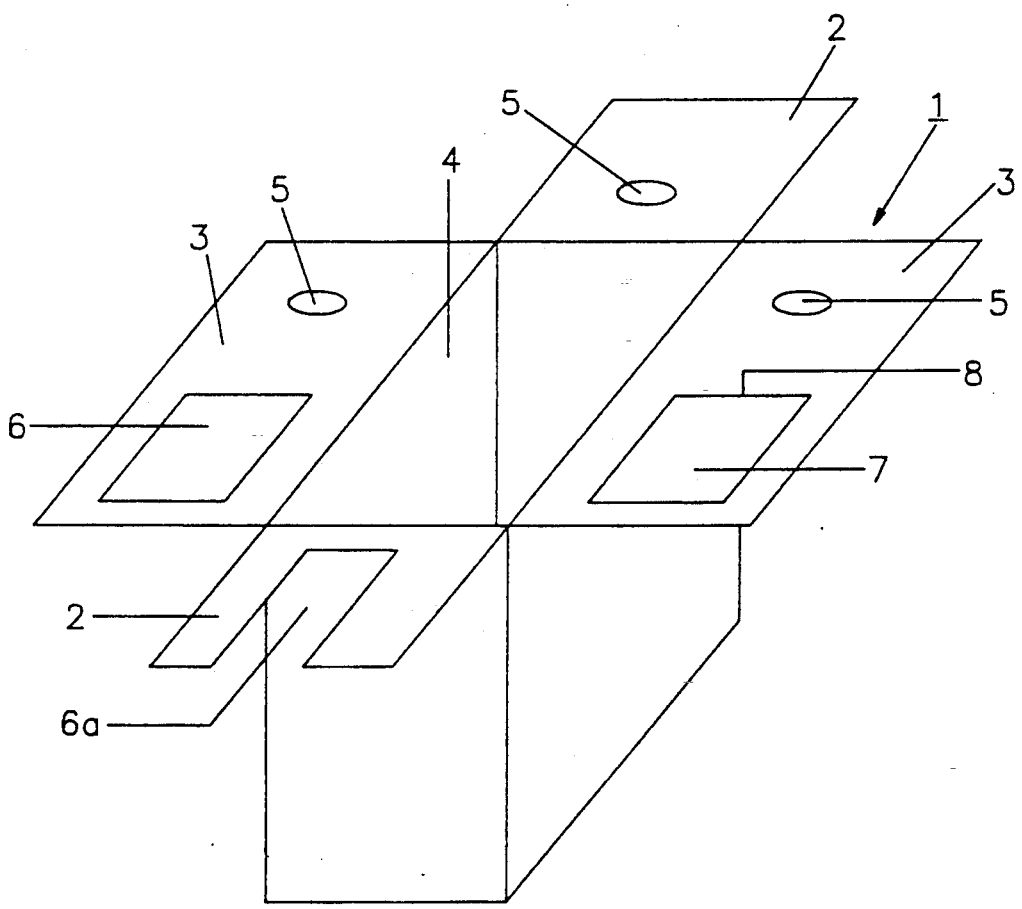
FIG. 1 is a perspective view of a folding box with open head laps.

FIG. 1 shows a folding box, for example of corrugated cardboard, globally denoted by the reference 1 with open, short inner head laps 2 and fully congruent outer head laps 3. In the closed position of the folding box, the head lap 3 provided with a removal opening 6 forms the lower outer head lap while the head lap 3 provided with a window flap 7 forms the upper outer head lap. In other words, the latter forms the outer surface in the closed position of the folding box 1. The length and width of the outer head laps 3 are identical with the dimensions of the open cross-section 4 of the folding box. One of the short head laps 2 and the two fully congruent head laps 3 have round bungholes 5 which can be punched out or prepunched, and which lie congruently over one another in the closed position of all the head laps 2 and 3. Similarly, the other short head lap 2 has a cutout or die cut 6*a* which, in the closed position of the head laps 2, 3, lies congruently to the removal opening 6 and the window flap 7. The removal opening 6 is best punched out completely from the outset, while the window flap 7 is only perforated by prepunching and is intended to remain connected hinge-fashion to the fully congruent head lap 3 by a one-sided hinge groove 8.

Figure 2:
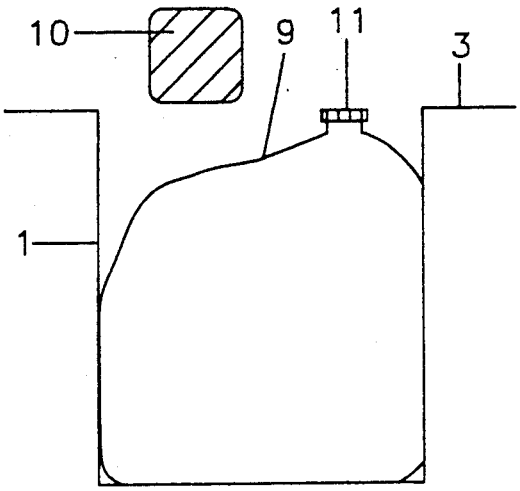
FIG. 2 is a longitudinal section through the folding box shown in FIG. 1 with a filled plastic sack placed therein.

FIG. 2 illustrates a phase in the production of a bag-in-box container including a folding box 1, a flexible sack 9 placed therein, and an article 10 to be added. In the production phase illustrated in FIG. 2, the filled sack 9 is introduced from above into the folding box 1 already closed at its base. The sack 9 may also be introduced empty into the folding box 1 and then filled through a closable bung 11. The volume of the filled sack 9 is smaller than the volume enclosed by the folding box 1 by the volume of the article 10. In other words, the sack 9 does not completely occupy the inner volume of the folding box 1 in FIG. 2.

Figure 3:
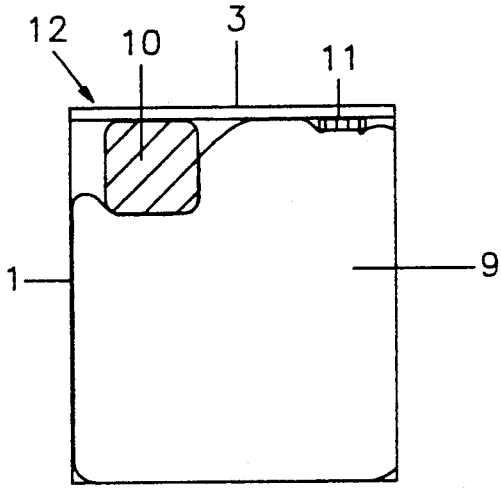
FIG. 3 is a section corresponding to FIG. 2 with closed head laps of the folding box.

FIG. 3 shows the position in which the article 10 is pressed into the flexible sack 9 so that the sum of the volumes of the filled sack 9 and the article 10 fills the inner volume of the folding box 1 substantially completely. Accordingly, after the end face 12 of the folding box 1 has been closed as in FIG. 3, the space available inside the folding box 1 is almost completely filled by displacement of the flexible sack 9.

Figure 4:
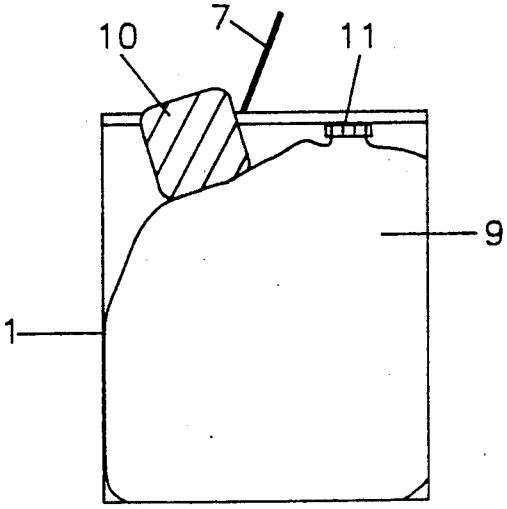
FIG. 4 is a section through a filled folding box with the removal window open.
Figure 5:
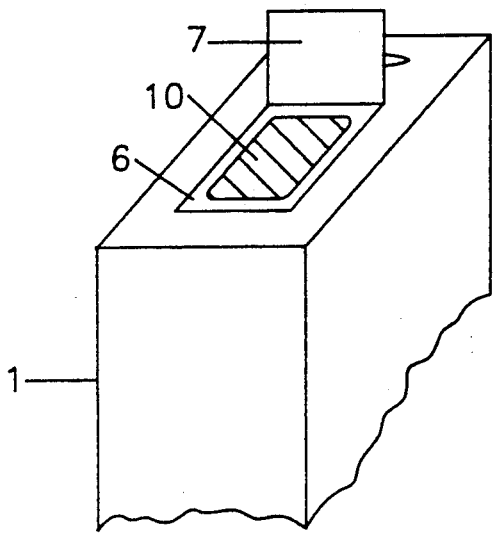
FIG. 5 is a perspective view of the folding box shown in FIG. 3 with the removal window open.

FIG. 4, which is a section through the folding box 1 shown in FIG. 3, shows how, after opening of the prepunched window flap 7, the article 10 is raised by the new distribution of product physically induced in the sack 9 and, projecting from the removal opening 6 corresponding to the window flap 7, can be conveniently removed providing the article 10 is lighter in weight than the volume of the contents of the sack 9 displaced by the article 10 in the position shown in FIG. 3. If, by contrast, the article 10 is heavier in weight than the volume of the sack contents which it displaces in FIG. 3, the article 10 remains in a position in the box which is shown by way of example in FIG. 5. The window flap 7 may be inexpensively made to act an originality closure.

Figure 6:
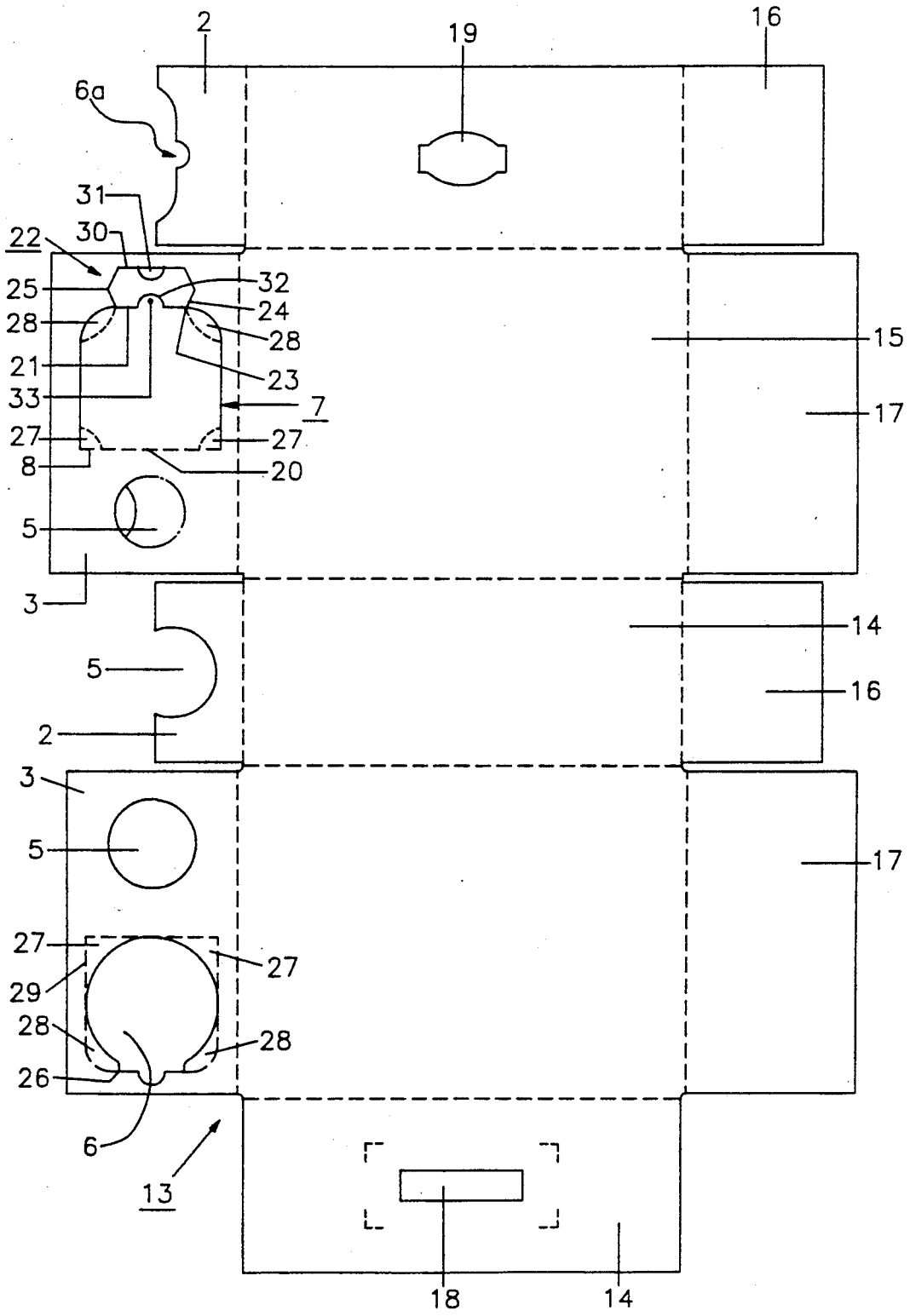
FIG. 6 shows the blank of a folding box with a modified removal window.

A flat blank of a folding box with a modified removal opening in relation to the embodiments shown in FIGS. 1 to 5 is shown in principle in FIG. 6. Identical or corresponding parts of the folding box are denoted by the same reference numerals as in FIGS. 1 to 5. In addition to the short head laps 2 and the fully congruent head laps 3, narrow and wide wall surfaces 14 and 15, respectively. Associated short bottom laps 16 and fully congruent bottom laps 17 are also shown in the blank 13 in FIG. 6. A carrying handle 18 may be integrated into the narrow wall surface 14, which forms the inner wall surface during erection and glueing, a griphole 19 optionally being associated with the carrying handle 18 in the other narrow wall surface 14.

The special aspect of the blank 13 shown in FIG. 6 compared with the embodiments shown in FIGS. 1 to 5 lies above all in the configuration of the window flap globally denoted by the reference 7 with the removal opening globally denoted by the reference 6 lying beneath it in the erected position of the folding box. In the same way as before, the window flap 7 is connected to the adjoining surface of the head lap 3 by a hinge groove 8. However, handling is easier because the hinge groove 8 is punched through at its center 20, so that only the remaining peripheral parts form the hinged connection between the window flap 7 and the head lap 3. One preferred feature of the embodiment shown in FIG. 6 is that that edge of the window flap 7 opposite the hinge groove 8 has an insertion lap 22 connected via a folding crease 21. For reclosing, the insertion lap 22 is turned inwards through 90° and pressed into the interior of the box.

Another preferred feature of the embodiment shown in FIG. 6 is that the insertion lap 22 formed from an outer head lap 3 is tucked in from both sides level with its folding crease 21, i.e. has waist-like tucks 23, to which correspond projections 24 directed towards one another in the remaining material of the head lap 3. If, in this construction, the insertion lap 22 is folded inwards through 90°, its lateral projections 25 formed by the tucks 23 engage beneath the projections 24, so that a window flap 7 thus pressed in will not open on its own.

Stability is increased even further if an insertion slot 26 holding the insertion lap 22 bent inwards through about 90° is associated with the insertion lap 22 in the lower outer head lap 3 which is situated on the inside beneath the window flap 7 in the erected position of the folding box. If the short head lap 2 projects below the removal opening 6 during erection of the folding box from the blank 13, corresponding cutouts 6*a* must be provided in the short head lap 2, as shown in FIG. 6. As in FIGS. 1 to 5, the same applies to the relationship of the bunghole 5 in the fully congruent head laps 3 and in the short head lap 2.

The window flap 7 is further stabilized in its reclosed position if the flap 7 has a larger area than the corresponding removal opening 6 of the underlying head lap 3 and, in the closed position of the folding box, lies at least locally at 27 and 28 on remaining parts of the underlying head lap 3. In FIG. 6, this relationship is symbolized by a chain line 29 around the periphery of the removal opening 6. In this way, the window flap 7 cannot be pressed any deeper than required into the erected folding box because it rests on the surface of the underlying head lap 3 at its four corners 27, 28, although a removal opening 6 is provided there.

However, in the embodiment shown in FIG. 6, the window flap 7 can not only be safely reclosed, it can also be readily opened after reclosing. To this end, the insertion lap 22 at its free end opposite the folding crease 21 is provided with a gripping recess 31, preferably in the form of a semicircular griphole, which is cut out, particularly by die punching, before or during production. The user grips in the gripping recess 31, for example when opening the window flap 7 for the first time. However, the gripping recess 31 does not afford any particular advantages in regard to the opening of a reclosed window flap 7, because the end of the insertion lap 22, on which the gripping recess 31 lies, projects into the interior of the erected folding box 1. Accordingly, to make a reclosed insertion lap 22 easier to open, a cutout 32 in the form of a convex curve extending towards the free end 30 is provided in the folding groove 21 of the insertion lap 22. The effect of the cutout 32 is that, when the insertion lap 22 is folded into the interior of the box, it exposes a projection in the form of a tongue 33 at which the window flap 7 can be held and raised against the locking effect of the protuberances 25 (under the projections 24).

Figure 7:
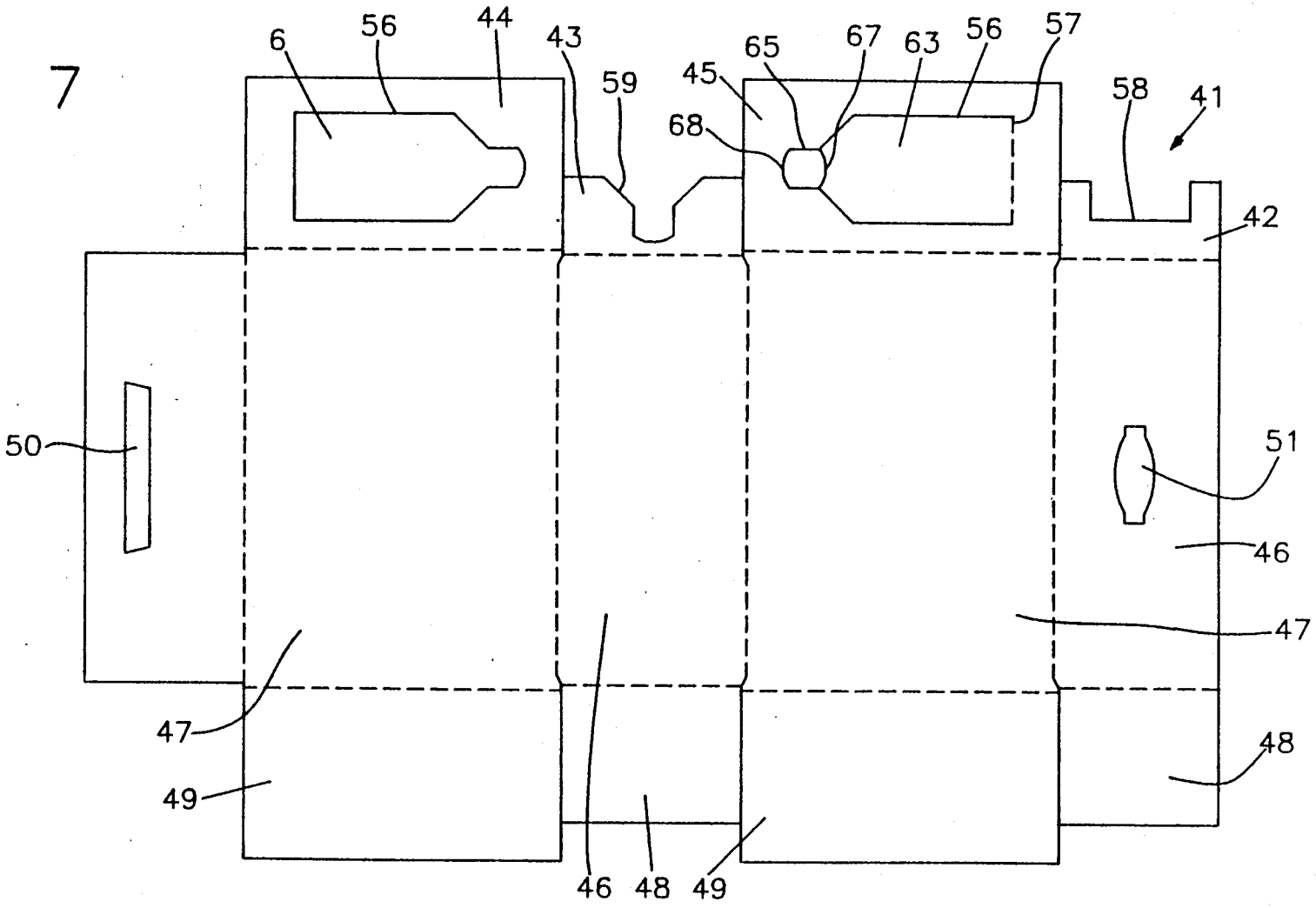
FIG. 7 shows the blank of a packaging container with the bunghole and adjoining window punched into the head laps.

FIG. 7 shows a blank globally denoted by the reference 41 of a square folding box comprising two short, inner head laps 42 and 43, a lower, fully congruent outer head lap 44 and an upper, outer fully congruent head lap 45. In addition, the blank 41 includes narrow and wide wall surfaces 46 and 47, respectively associated short bottom laps 48 and fully congruent bottom laps 49. A carrying handle 50 may be integrated into the narrow wall surface 46, which forms the inner wall surface after erection and glueing, a griphole 51 optionally being associated with the carrying handle 50 in the other, outer narrow wall surface 46 of the blank 41.

Figure 8:
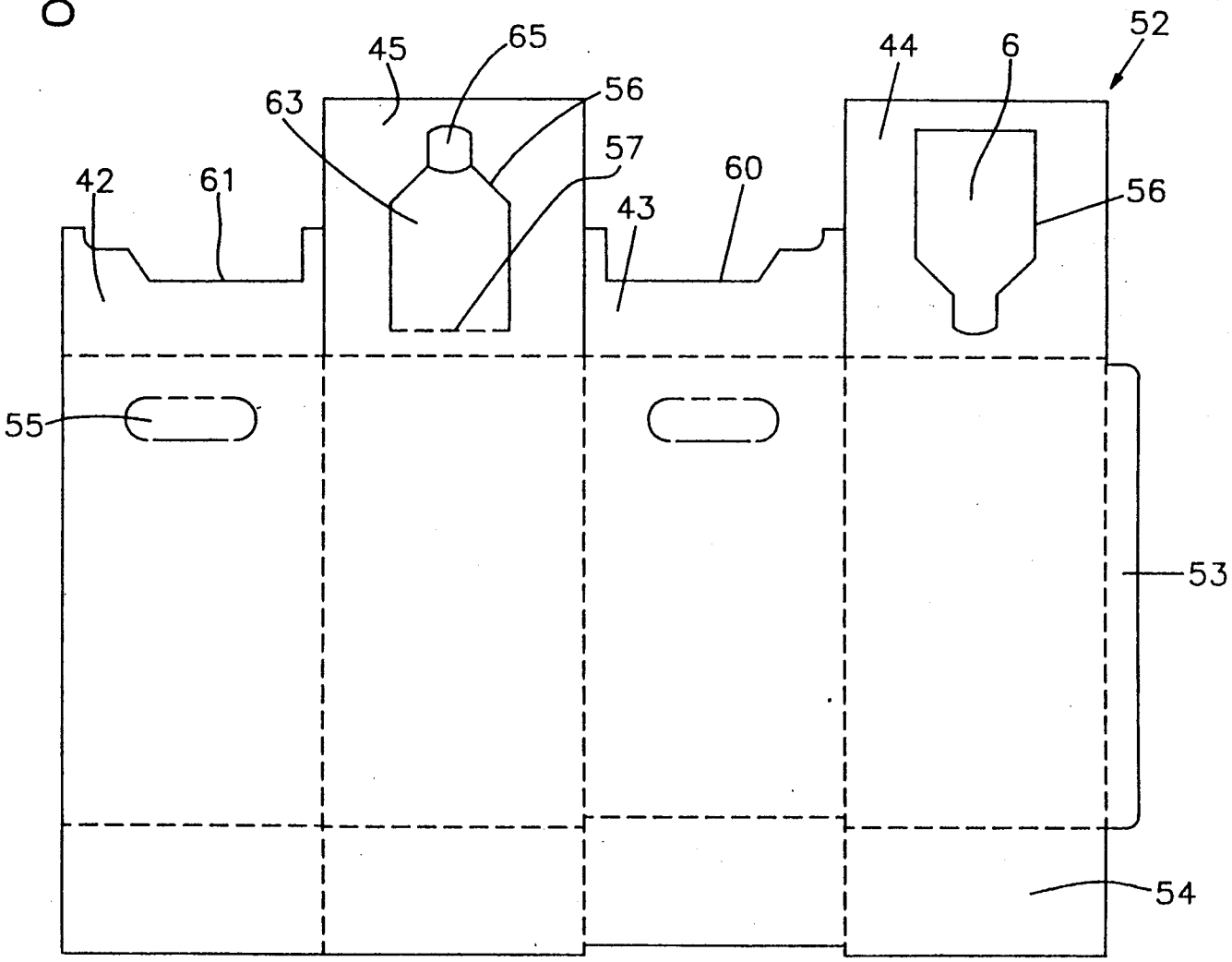
FIG. 8 shows a similar blank as in FIG. 7, but with alternatively arranged perforations in the head laps.

The blank 52 shown in FIG. 8 is prepared in basically the same way as the blank 41 shown in FIG. 7. Accordingly, the blank 52 has identical, but alternatively arranged cutouts in the short head laps 42 and 43 and in the fully congruent head laps 44 and 45. As an alternative, FIG. 8 also shows that, for erection, the cutout 52 has only one narrow glueing lap 53 and, at its base, four identical bottom laps 54. The carrying handle 50 in FIG. 7 is replaced by grip holes 55 in FIG. 8.

The fully congruent head laps 44 and 45 shown in FIGS. 7 and 8 have punched lines 56 and a crease line 57, which in principle are or may be identical, but in FIG. 7 are arranged offset through 90° in relation to FIG. 8. Accordingly, the short head laps 42 and 43 comprise different punched lines 58, 59, 60 and 61. The latter punched lines and the cutouts thus obtained are arranged in such a way that, when the folding box is erected and the head laps are folded onto one another, they lie congruently to the removal opening 6 and the congruent window flap 63.

Figure 9:
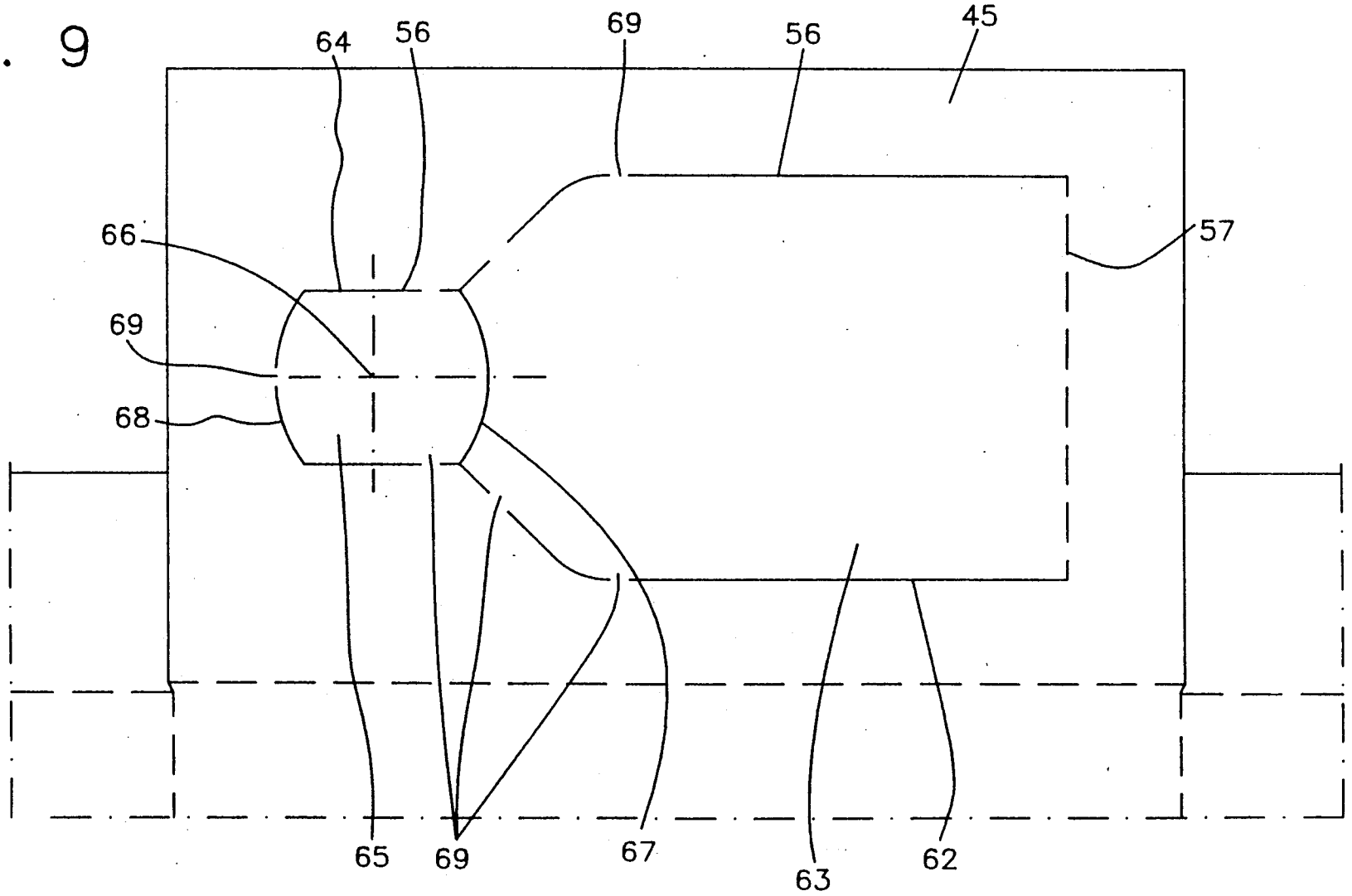
FIG. 9 is a detailed view of the bunghole and window formed in a head lap as shown in FIG. 7.

An upper, outer, fully congruent head lap 45 according to FIG. 7 is shown by way of example in FIG. 9. This head lap comprises—adjoining one another—a window 62 with a window flap 63 arranged therein in the originality state and a bunghole 64 with a press-in surface 65 arranged therein in the originality state. A center point 66 is defined for the bunghole 64 and the press-in surface 65.

As shown in FIG. 9, the head lap 45 according to FIG. 7 comprises punched lines 56 extending parallel to one another, a crease line 57 and punched lines 67 and 68 extending circularly about the center point 66. The radius of curvature of the punched line 67 may be larger than the radius of curvature of the punched line 68. The punched lines 56 and 68 are preferably interrupted by so-called punched bridges 69 while the punched line 67 is best not interrupted at all. However, all the punched lines may be replaced by perforation lines.

A construction having punched lines and crease lines and the associated punched bridges according to FIG. 9 is characterized by an outer head lap 45 which represents an originality-sealed, indentable opening for a closure system arranged in the erected pack and defines a bunghole 64—designed to be torn open—with an adjoining window 62, the window being designed to open and reclose hinge-fashion using the crease line 57. For satisfactory operation of the window 62 in particular, all the other head laps provided with cutouts or die cuts and optionally lying below the outer head lap 45 should extend congruently to one another in the erected position of the pack. The same naturally applies to the blank 52 shown in FIG. 8 with the punched lines and crease lines of the outer head lap 45 turned through 90°. In the erected position of the folding box, the order of the head laps from inside to outside is as follows: short inner head laps 42, 43, lower outer head lap 44 and, finally, upper outer head lap 45. The cutouts and/or die cuts lie congruently over one another. Outside the removal opening, the laps are glued to one another over their contact surfaces, as is normally the case with folding boxes.

Figure 10:
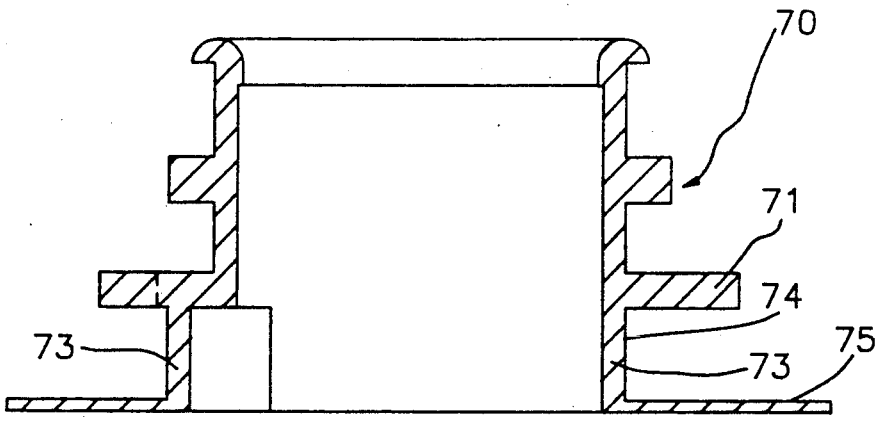
FIG. 10 is a section on the line IX—IX of FIG. 11.
Figure 11:
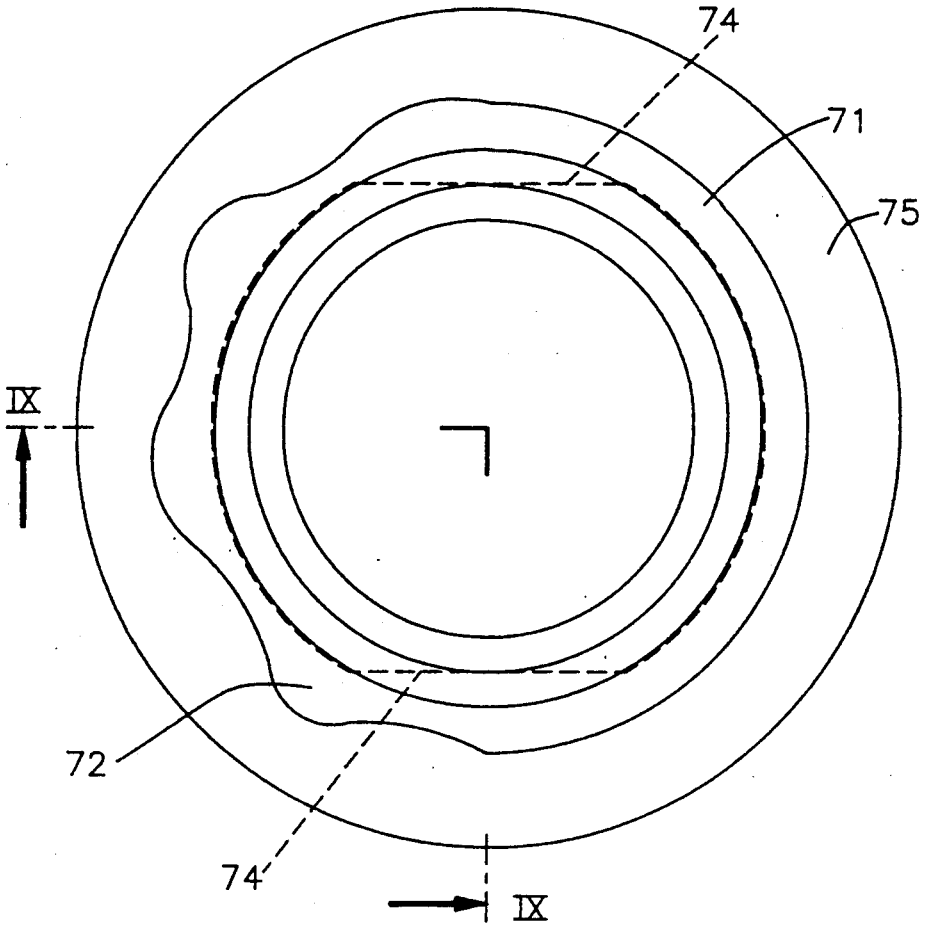
FIG. 11 is a plan view of an outlet bung.

FIGS. 10 and 11 show one example of an embodiment of an outlet bung 70 which, at its lower end adjoining the flexible sack, is designed in such a way as to be easy to fit by the user when the pack based on the folding boxes described above is being prepared for use. To understand FIGS. 10 and 11, note that FIG. 10 is a section on the line IX—IX of FIG. 11. The outlet bung 70 shown in FIG. 10 is intended to be safely fixed in the head lap of the erected folding box shown in FIGS. 1 to 9, problem-free removal of the emptied inner bag or sack being guaranteed for the purpose of separate disposal.

To this end, the bung 70 is provided with a stable, relatively large and clearly visible flange 71 which is symmetrical in rotation, but preferably is partly in the form of a rosette 72 (FIG. 11). Above the flange 71, the outlet bung 70 is typically symmetrical in rotation, while an intermediate part or neck 73 beneath the flange 71 is in the form of a flattened tube section with two guide surfaces 74 running parallel to one another (dashed lines in FIG. 11). At its lower edge, the neck 73 adjoins a welding flange 75 onto which the sack (76 in FIGS. 12 and 13) is welded.

Figure 12:
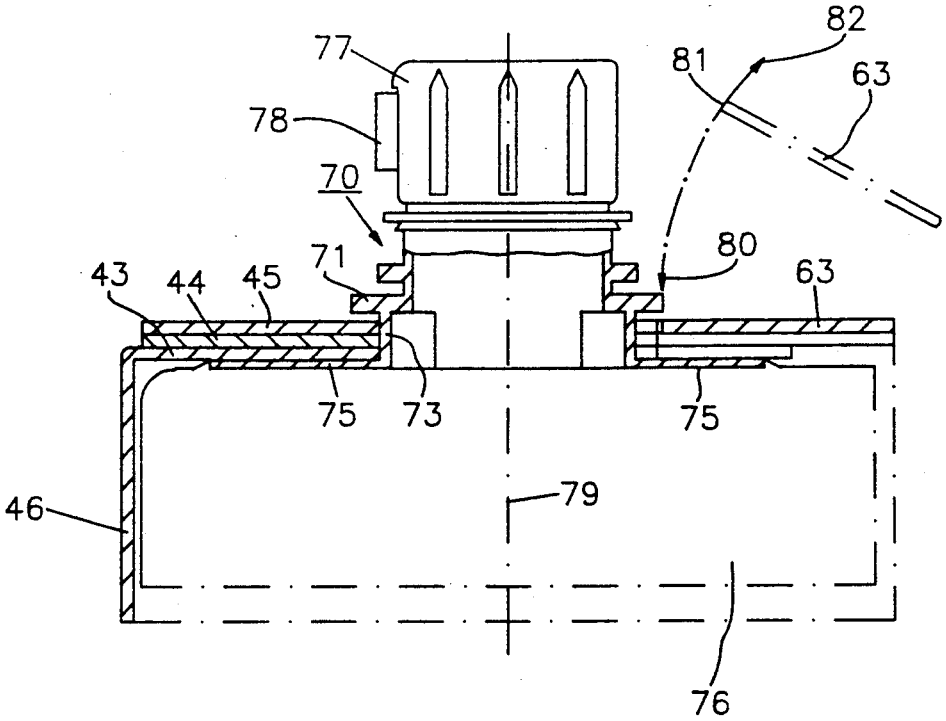
FIG. 12 shows the arrangement of an outlet bung with pouring opening in the ready position in a bunghole within the head laps (shown in section) glued to one another.
Figure 13:
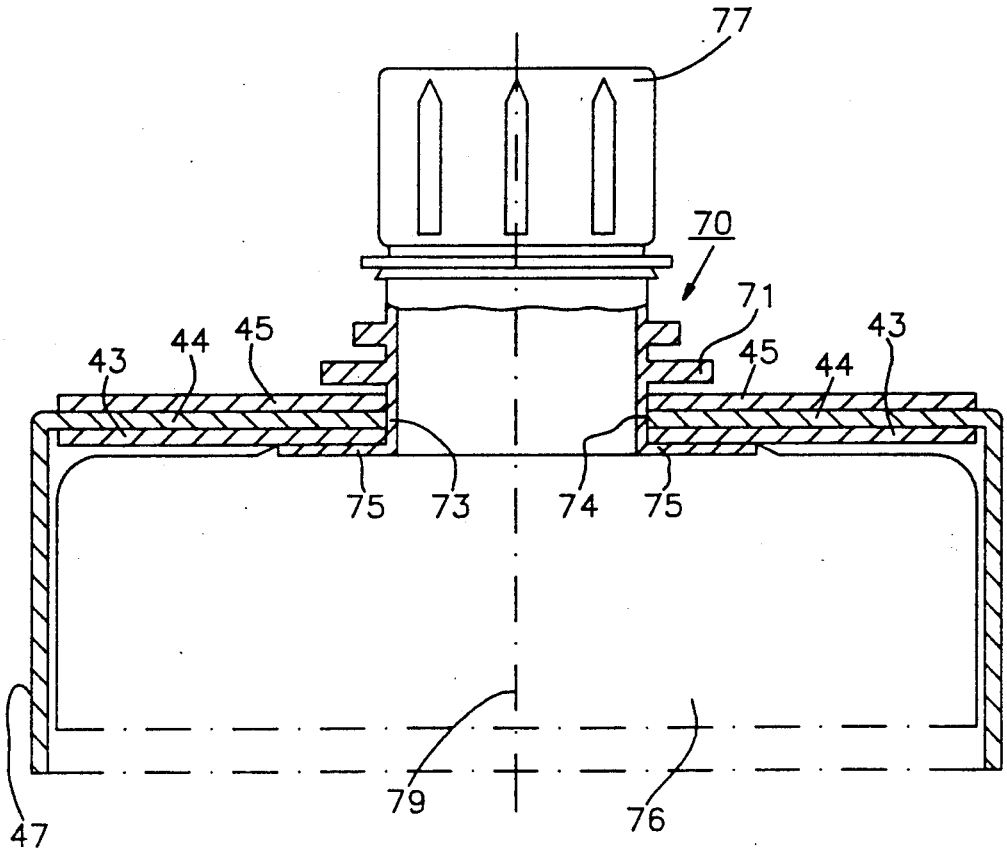
FIG. 13 is an elevation taken transversely of the elevation in FIG. 12 of the outlet bung with the adjoining head region of the pack shown in section.

FIGS. 12 and 13 show the head region of a square folding box made, for example, from the blank shown in FIG. 7 with short and fully congruent head laps 43, 44 and 45 glued to one another. FIG. 12 shows the outlet bung 70 surmounted by a tap 77 seen partly in section from a wide wall surface 47 (FIG. 7), so that the pouring opening 78 of the tap 77 faces towards a narrow wall surface 46. FIG. 13 shows the outlet bung 70 surmounted by the tap 77 with the adjoining parts of the pack shown in section, as seen from the direction of a narrow wall surface 46.

FIGS. 12 and 13 are based on an assembled closure system ready for use with an outlet bung 70 and glued head laps 43, 44, 45 according to FIGS. 7 and 8. The insides of the punched lines 56, 58, 59, 67 and 68 of the head laps 43 to 45 according to FIGS. 7 and 9, which define the bunghole 64, surround the neck 73 of the outlet bung 70 from three sides, and thus simultaneously orienting the pouring opening 78 of the tap 77 into the required direction, and securing the outlet bung 70 and hence the tap 77 against rotation about their axis (of symmetry) 79. The guide surfaces of the outlet bung 70 are prevented from sliding out of the cutouts in the head laps by the reclosing of the window flap 63 (closing direction 80). In the embodiment illustrated, the removal window 63 consists of parts of the head lap 45. The free end of the removal window 63, at its outer edge 81 formed by the punched line 67, snaps in beneath the flange 71 on the outlet bung 70 and thus engages between the flange 71 and the welding flange 75. To lift the window flap 73 out of this fixed position in the opening direction 82, a certain force has to be overcome, so that secure positioning of the outlet bung 70 has to be guaranteed.

In the original state, both the window 62 and the bunghole 64 are closed because the originality or punched bridges 69 of the outer head lap 45 (FIG. 9) are intended to fix the window flap 63 and the bunghole press-in surface 65 in the surrounding surface of the head lap 45.

When the packaging container is put into operation, the press-in surface 65 filling the bunghole 64 is first pressed in by the user, after which the window flap 63 is pulled outwards. The punched bridges 69, which represent the guarantee of originality, are thus broken. The outlet bung 70 likewise accommodated in the pack in the originality state is raised, optionally after removal of a user aid accommodated in the pack beneath the window flap 63, and, as described above, is fixed by insertion into the bunghole 64 and closure of the window flap 63. Where the pack is handled in this way, a rosette 72 on the circumference of the flange 71 can be of informative value to the user if the surface of the folding box is printed with corresponding symbols to make clear the orientation of the pouring opening 78 intended by the manufacturer.

After the packaging container has been completely emptied, the window flap 63 can be opened again to enable plastic parts present in the envelope to be removed in one step through the window 62—for the separate disposal of paper and plastic—when the outlet bung 70 is laterally withdrawn from the three sided surrounding of carton in the bunghole 64.

Figure 14:
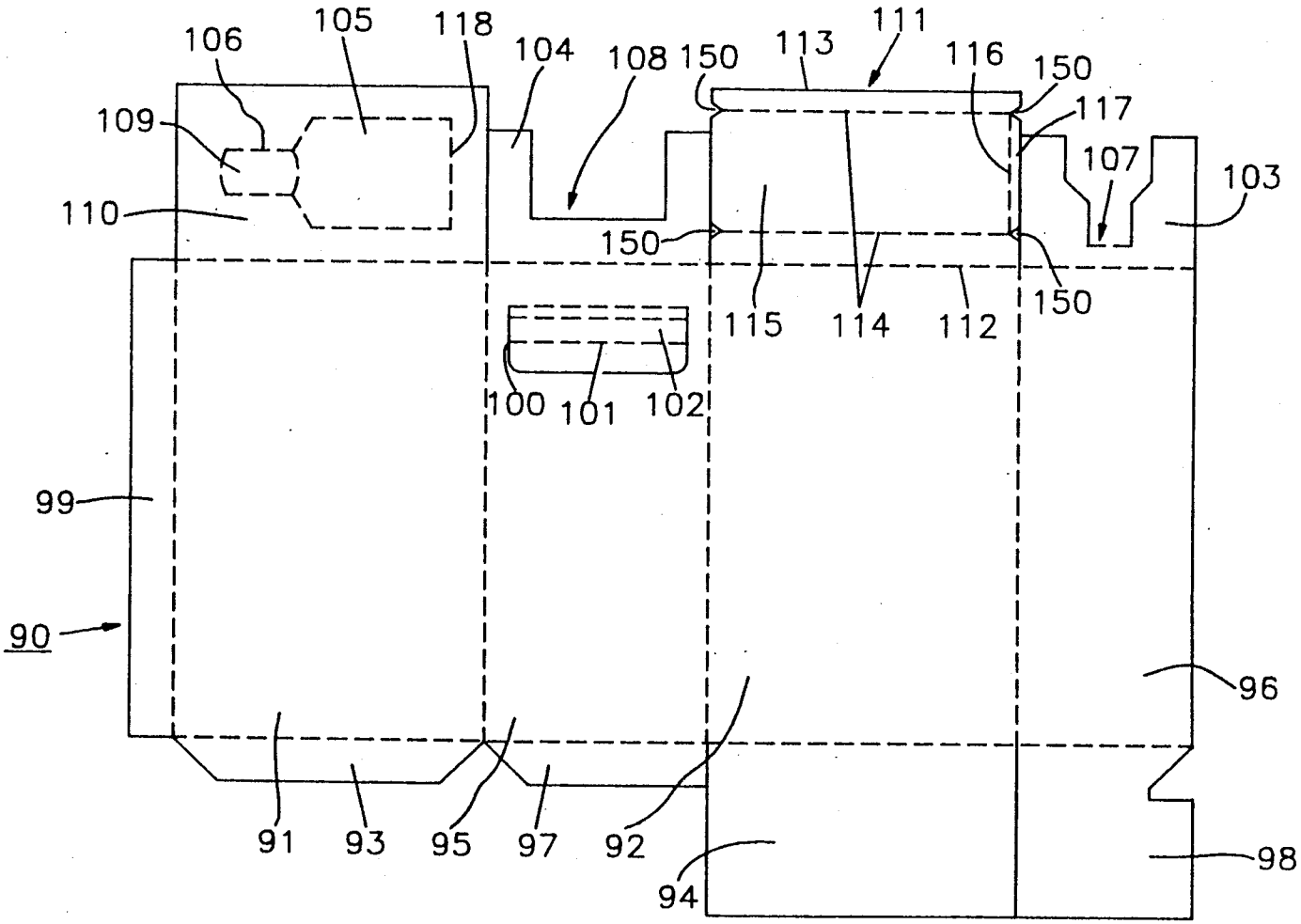
FIG. 14 shows the blank of an alternative embodiment of the invention.
Figure 15:
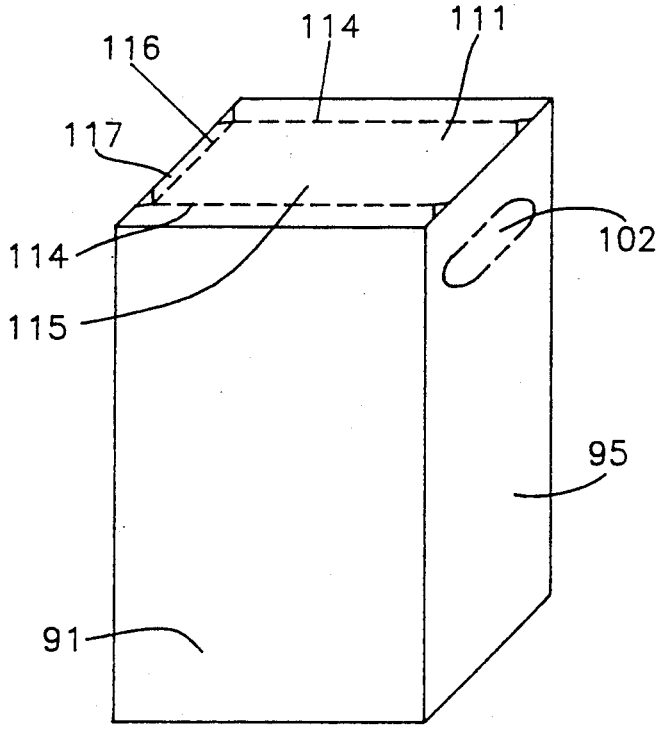
FIG. 15 shows a packaging container formed from the blank shown in FIG. 14.
Figure 16:
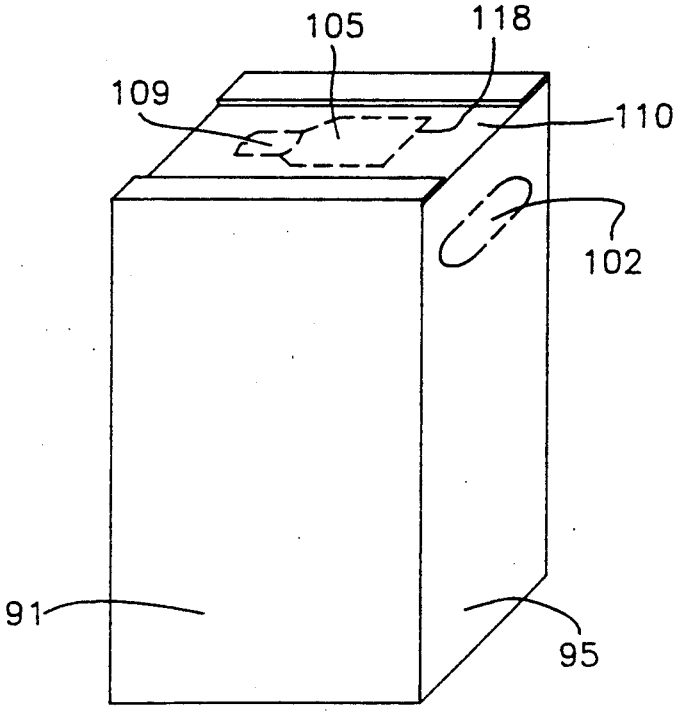
FIG. 16 shows the packaging container according to FIG. 15 with the upper outer head lap torn open.

FIGS. 14 to 16 show another alternative embodiment of a blank for a packaging container. The blank, which is globally denoted by the reference 90 in FIG. 14 comprises two surfaces 91 and 92 forming the wide sides of the erected packaging container with bottom laps 93 and 94 hinged thereto, and regions 95 and 96 forming the narrow sides of the packaging container with bottom laps 97 and 98 hinged thereto. When the box blank 90 is erected, the bottom laps 93, 94, 97 and 98 are positioned over one another in the usual way and glued to one another. Another glueing lap 99 is laterally hinged to the surface 91. In addition, the narrow side 95 comprises a gripping flap 102 defined by a perforation line 100 and comprising crease lines 101. When the box blank is erected, the gripping flap 102 is pressed inwards and thus exposes a carrying handle opening. The head laps of the box blank 90 consist of two short head laps 103 and 104 which lie on the inside in the erected position of the box blank and which are hinged to the surfaces 96 and 95 of the box blank. As in the other embodiments, the head laps 103 and 104 comprise the cutouts 107 and 108, respectively adapted to the contours of the window flap 105 and the bunghole 106. In the erected position of the box blank, the lower, fully congruent outer head lap 110, which is provided with the window flap 105 and the bunghole 106 or the flap 109 covering the bunghole 106, lies on these inner head laps 103 and 104. The uppermost layer and hence the outer surface of the packaging container in the head region is formed by another fully congruent head lap, namely the upper outer head lap 111. The head lap 111 comprises two perforation lines 114 which extend parallel to the edge 112, where the head lap 111 is connected to the region 92 of the folding box, and parallel to its longitudinal edge 113. The middle part 115 of the head lap 111 is defined by these two perforation lines 114. The perforation lines 114 are spaced so far apart from one another that they lie outside the contours of the window flap 105 and the bunghole flap 109 in the erected position of the packaging container. The middle part 115 is uninterrupted and, by virtue of the above-described arrangement of the perforation lines 114, is fully congruent with the window flap 105 and the bunghole flap 109. The regions remaining between the outer edge 113 and the nearest perforation line 114 and between the connecting line 112 and the nearest perforation line 114 serve as glueing surface for glueing the head lap 111 and the underlying head lap 110. In addition, the head laps 103 and 104 may also be glued to the overlying head lap 110. Parallel to one narrow side edge, the head lap 111 comprises a crease line 116 at a short distance from and parallel to this narrow side edge. This crease line divides off a gripping strip 117 in the middle part 115, at which the middle part can readily be gripped and torn off along the perforation lines 114 to expose the window flap 105 and the bunghole flap 109. In order to make the middle part even easier to tear off or tear up, a notch 150 is provided in the head lap 111 at the beginning and end of the perforation lines 114.

FIG. 15 shows a packaging container erected from the box blank according to FIG. 14 in the closed position. FIG. 16 shows the packaging container with the middle part 115 torn off to expose the window flap 105 and the bunghole flap 109. Accordingly, the packaging container is put into operation by first lifting up and gripping the gripping strip 117 and removing the middle part 115 along the perforation lines 114. The bunghole flap 109 thus exposed is then removed and the window flap 105 is lifted up along the crease or perforation line 118. A user aid packed in the container, for example in the form of a measuring cup, is removed through the removal opening thus exposed or, alternatively, the outlet bung of the filled sack is taken up and inserted into the bunghole 106. The window flap 105 is then closed again. The packaging container is thus ready for tapping. Accordingly, in this embodiment of the packaging container, the window flap and the bunghole are particularly protected, the outer head lap 111 virtually acting as a protective flap.

Although various embodiments of the invention have been shown and described for purposes of illustration, they are not meant to be limiting. Certain modifications of these embodiments may occur to those of skill in the art, which modifications are meant to be covered by the spirit and scope of the appended claims.

What is claimed is:

1. A packaging container for accommodating a liquid product, comprising a rigid envelope and, mounted therein, a flexible sack with a closable outlet bung and, associated therewith, a passage or bunghole of said envelope, an article to be added for handling the product adapted to be introduced at a predetermined position into the space between said envelope and said sack and in that a wall of the envelope has a reclosable window flap for removing and replacing the article to be added via a removal opening associated with said window flap.

2. A packaging container as claimed in claim 1, wherein said window flap is in the form of a reclosable originality closure, and adjoins the predetermined position of the article to be added.

3. A packaging container as claimed in claim 1, wherein the volume enclosed by the rigid envelope is only larger than the volume of the filled sack, including said outlet bung, by the volume of the article to be added.

4. A packaging container as claimed in claim 1, wherein the window flap is arranged in an upper end face of the container, said upper end face including said bunghole.

5. A packaging container as claimed in claim 1, further including two fully congruent, outer head laps lying one above the other, of which the lower outer head lap has a removal opening in the form of a hole for the article to be added, while the upper outer head lap has said reclosable window flap corresponding dimensionally to the removal opening, and further includes two short inner head laps with cutouts adapted to the contours of the window flap and said removal opening.

6. A packaging container as claimed in claim 1, wherein the window flap is connected to an adjoining surface of said head lap by a hinge groove optionally cut in a central region and, at its edge opposite the hinge groove, comprises an insertion lap integrally formed via a folding crease.

7. A packaging container as claimed in claim 6, further including the insertion lap formed from an outer head lap being tucked in from both sides level with the folding crease, and an insertion slot holding said insertion lap being bent inwards through about 90°, and being associated with the insertion lap in the inner head lap beneath the window flap.

8. A packaging container as claimed in claim 6, further including at its free end opposite the folding crease, said insertion lap having a gripping recess, in the form of a semicircular griphole, which is cut out during or before production.

9. A packaging container as claimed in claim 6, wherein in the folding crease, said insertion lap has a convex cutout extending towards the free end of the insertion lap.

10. A packaging container as claimed in claim 6, wherein the window flap has a larger area than the corresponding removal opening of the underlying head lap and, in the closed position, lies locally on the remaining parts of the lower head lap.

11. A packaging container as claimed in claim 5, further including between its pouring opening and the adjoining sack, said outlet bung including a neck with two integrally formed, radially projecting flanges, the distance between the flanges being substantially equal to the wall thickness of the envelope in the region of the bunghole, the outer periphery of the neck being adapted to the passage defined by the bunghole, wherein around approximately one quarter of its circumference, the bunghole adjoins a window in the envelope large enough to grip through.

12. A packaging container as claimed in claim 11, further including said reclosable window flap with a hinge in the form of a crease line provided on that side of said envelope remote from the bunghole.

13. A packaging container as claimed in claim 12, wherein at its outer edge adjoining the bunghole, the window flap is adapted to the circumference of that side of the outlet bung to be inserted which faces the window and is secured between said two flanges.

14. A packaging container as claimed in claim 13, wherein the neck of the outlet bung, in the region between the flanges, is in the form of a flattened tube section to prevent rotation.

15. A packaging container as claimed in claim 14, wherein a flange of the outlet bung lying on the outside of the envelope is adapted to be distinctly visible in the form of a rosette to an orientation plan provided on the envelope.

16. A packaging container as claimed in claim 15, wherein the edges of the bunghole and the window are congruently formed throughout by all of said head laps lying one above the other and forming an envelope wall.

17. A packaging container as claimed in claim 16, further including the surfaces of the envelope defined by the window and the bunghole are defined by cut or punched lines interrupted by originality bridges.

18. A packaging container as claimed in claim 17, wherein that section of the punched line provided at the boundary between the window flap and the bunghole press-in surface is continuous.

19. A packaging container as claimed in claim 1 further including a fully congruent, lower outer head lap with a window flap and bunghole flap defined therein by perforation lines, in that it comprises two short inner head laps with cutouts congruently adapted to the contours of the window flap and a bunghole flap, and in that it comprises a fully congruent, upper outer head lap which completely covers the contours of the window flap and the bunghole flap.

20. A packaging container as claimed in claim 19, further including the upper outer head lap with two perforation lines which extend parallel to its longitudinal edge and its pivotal edge, and which are arranged outside the contours of the window flap and the bunghole.

21. A packaging container as claimed in claim 20 further including the outer regions remaining between the perforation lines and the longitudinal edge or pivotal edge in the form of a gluing surface for joining the two outer head laps.

22. A packaging container as claimed in claim 21, further including on one narrow side edge of the middle part defined by the perforation lines, a crease line extending parallel to the narrow side edge formed to define a gripping strip, wherein after the sack is filled and introduced into the rigid envelope, but before the rigid envelop is closed, the article is pressed into the outer surface of the sack and the envelope is then closed, and said packaging container is placed into use by pressing in the press-in surface occupying the bunghole to break the originality bridge, and the window flap occupying the window is opened outwards, whereafter the outlet bung is removed from the interior of the pack, and the flange provided on its neck is inserted into the bunghole also provided on its neck, and fixed in position by closing the window flap.

* * * * *